United States Patent [19]

Saiki et al.

[11] Patent Number: 4,917,291

[45] Date of Patent: Apr. 17, 1990

[54] UNITARY GIFT BOX

[76] Inventors: Shinzo Saiki, 10 Crystal Dr., Great Neck, N.Y. 11021; Kuniaki Nomura, 61 Jones St., New York, N.Y. 10014

[21] Appl. No.: 385,182

[22] Filed: Jul. 26, 1989

[51] Int. Cl.[4] ..... B65D 5/24

[52] U.S. Cl. ..... 229/155; 229/40; 229/922

[58] Field of Search ..... 229/40, 922, 155, 170

[56] References Cited

U.S. PATENT DOCUMENTS

| | | | |
|---|---|---|---|
| 886,058 | 4/1908 | Hollett | 229/155 |
| 1,112,559 | 10/1914 | Reilly | 229/40 |
| 1,440,233 | 12/1922 | Noel | 229/40 |
| 1,760,106 | 5/1930 | Beach | 229/40 |
| 2,792,167 | 5/1957 | Sparks | 229/40 |
| 2,987,237 | 6/1961 | Bemiss et al. | 229/40 |
| 3,027,063 | 3/1962 | Zastrow | 229/40 |

FOREIGN PATENT DOCUMENTS

| | | | |
|---|---|---|---|
| 268827 | 10/1929 | Italy | 229/155 |
| 481484 | 8/1954 | Italy | 229/155 |
| 247138 | 11/1947 | Switzerland | 229/155 |
| 299143 | 8/1954 | Switzerland | 229/155 |
| 682854 | 11/1952 | United Kingdom | 229/40 |

*Primary Examiner*—Gary Elkins

*Attorney, Agent, or Firm*—Michael Ebert

[57] ABSTRACT

A cardboard blank that is die-cut and scored to define, when the blank is erected, a unitary box having bottom, side and end walls, as well as interlockable triangular side and end flaps providing a closed cover.

4 Claims, 2 Drawing Sheets

UNITARY GIFT BOX

BACKGROUND OF INVENTION

1. Field of Invention:

This invention relates generally to knock-down cardboard boxes, and more particularly to a unitary box formed from a single blank of cardboard that is scored and die-cut to define all of the elements of the box including its cover.

2. Status of Prior Art:

Many consumer items are purchased at their point of sale in an unpackaged state or in a soft package such as a plastic-film envelope. If, therefore, one buys, say, a costly blouse or any other unpackaged item in a department store or boutique and wishes to present this garment as a gift, the store will usually furnish the purchaser with an attractive gift box for the purpose.

The typical gift box is constituted by an open box and a removable cover therefor. Since consumer items come in many sizes, in order to satisfy customer needs for gift boxes, the retail establishment must keep in inventory gift boxes in a range of sizes, each suitable for an article of a given size.

Because such boxes are three-dimensional and have a significant volume, to maintain a large inventory of conventional gift boxes, a commodious storage space is required. Adequate space for this purpose may not be available in a small boutique or other store in which the storage space is largely reserved for goods to be sold. But even if storage space for gift boxes is available, it is space taken away from other goods and represents an added overhead expense.

It is for this reason that many retail stores stock so-called knock-down boxes which are in a flattened form so that the boxes can be stacked and stored in a relatively small space. These knock-down boxes usually have a box section and a complementary cover section, thereby making it necessary to convert both sections from a flattened to an erect state, a time consuming procedure. And even though these knock-down boxes are relatively expensive, their cost must be borne by the seller, for it is not the usual practice to charge a customer for boxing his purchase.

Another problem encountered with conventional boxes is that when a relatively fragile article is boxed therein, when one wishes to remove the article from the box, it must be lifted out of the box. If this action is carried out carelessly, it may result in damage to the article. If the article to be boxed, is say, a soft pastry or pizza pie, removing the pie from the box without damaging it may be difficult. A similar difficulty may be encountered in putting a pie into a box.

SUMMARY OF INVENTION

In view of the foregoing, the main object of this invention is to provide a unitary gift box formable from a single blank of cardboard that is scored and die-cut to define all of the elements of the box, including its cover.

More particularly, an object of the invention is to provide a unitary box having bottom, side and end walls as well as a pair of interlockable triangular side flaps and a pair of interlockable triangular end flaps which when folded in are interlocked to create a closed cover and buttressed corners.

Also an object of the invention is to provide a unitary knock-down box that may be manufactured and sold at low cost, that is highly attractive and therefore suitable as a gift box, and which may be shipped and stored in a flat, stacked state, so that relatively little storage space is required for a large number of boxes.

A significant advantage of a box in accordance with the invention is that an article to be boxed is placed on a flat blank which is then erected to form a closed box about the article, and that to thereafter open the box, it is restored to its flat state. Hence it is not necessary to manipulate and possibly damage the article when boxing or de-boxing it.

Briefly stated, these objects are accomplished by forming a unitary box from a single, die-cut and scored blank of cardboard that includes a main rectangular section having triangular end flaps extending from either end thereof. A first transverse fold line is scored at the junction of each end flap and the main section, and a second transverse fold line is scored in parallel to the first line. Extending from either side of the main section between the second transverse lines is a triangular side flap, a first longitudinal fold line being scored at the junction of this side flap and the main section.

Scored in the main section is a second longitudinal fold line which is parallel to the first longitudinal score line and extends into the end flaps to intersect the first and second transverse lines to define the end and side walls of the box and trapezoidal corner zones interconnecting these walls. Each zone has a diagonal fold line scored therein extending between the apex of the trapezoid and the intersection of the second transverse and second longitudinal lines, each intersection being at a corner of the bottom wall defined by these lines.

To erect the box, the side walls are folded up to be at right angles to the bottom wall, and the triangular side flaps are folded in and interlocked at their apexes. Then the end walls are folded up to be at right angles to the bottom wall, this action causing the trapezoidal zones to fold in on their diagonal lines to form corner gussets which when the end flaps are then folded in to overlie the interlocked side flaps, swing against the end walls to buttress the corners. Finally, the end flaps are interlocked at their apexes to complete the box.

BRIEF DESCRIPTION OF DRAWING

For a better understanding of the invention as well as other objects and further features thereof, reference is made to the following detailed description to be read in conjunction with the accompanying drawings, wherein.

.

DESCRIPTION OF INVENTION

Figure 1:
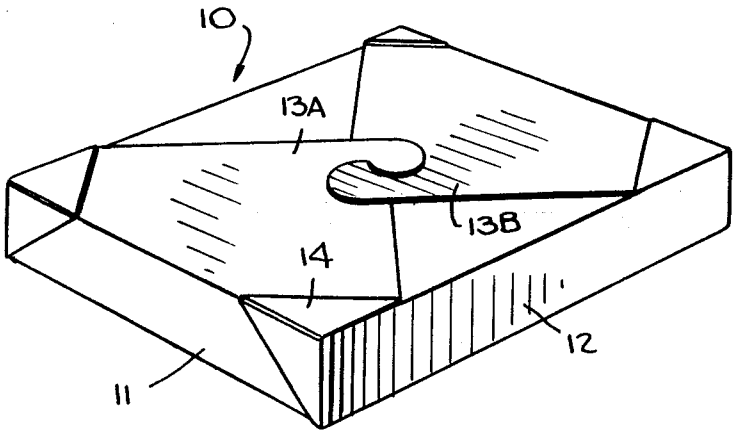
FIG. 1 is a perspective view of a unitary box in accordance with the invention.

Referring now to FIG. 1, there is shown a unitary box 10 in accordance with the invention, the box having end walls 11, side walls 12 and a cover including a pair of interlocked triangular end flaps 13A and 13B. The corners of the box are bolstered by gussets 14.

The box is formed from a single blank of cardboard or synthetic plastic sheeting having similar properties. While the box, because of its inherent attractiveness, is suitable as a gift box, it may be used for strictly utilitarian applications, such as a box for a pizza or pastry pie. It may for this purpose be formed of waterproof, thermal insulation, multi-ply material.

Figure 2:
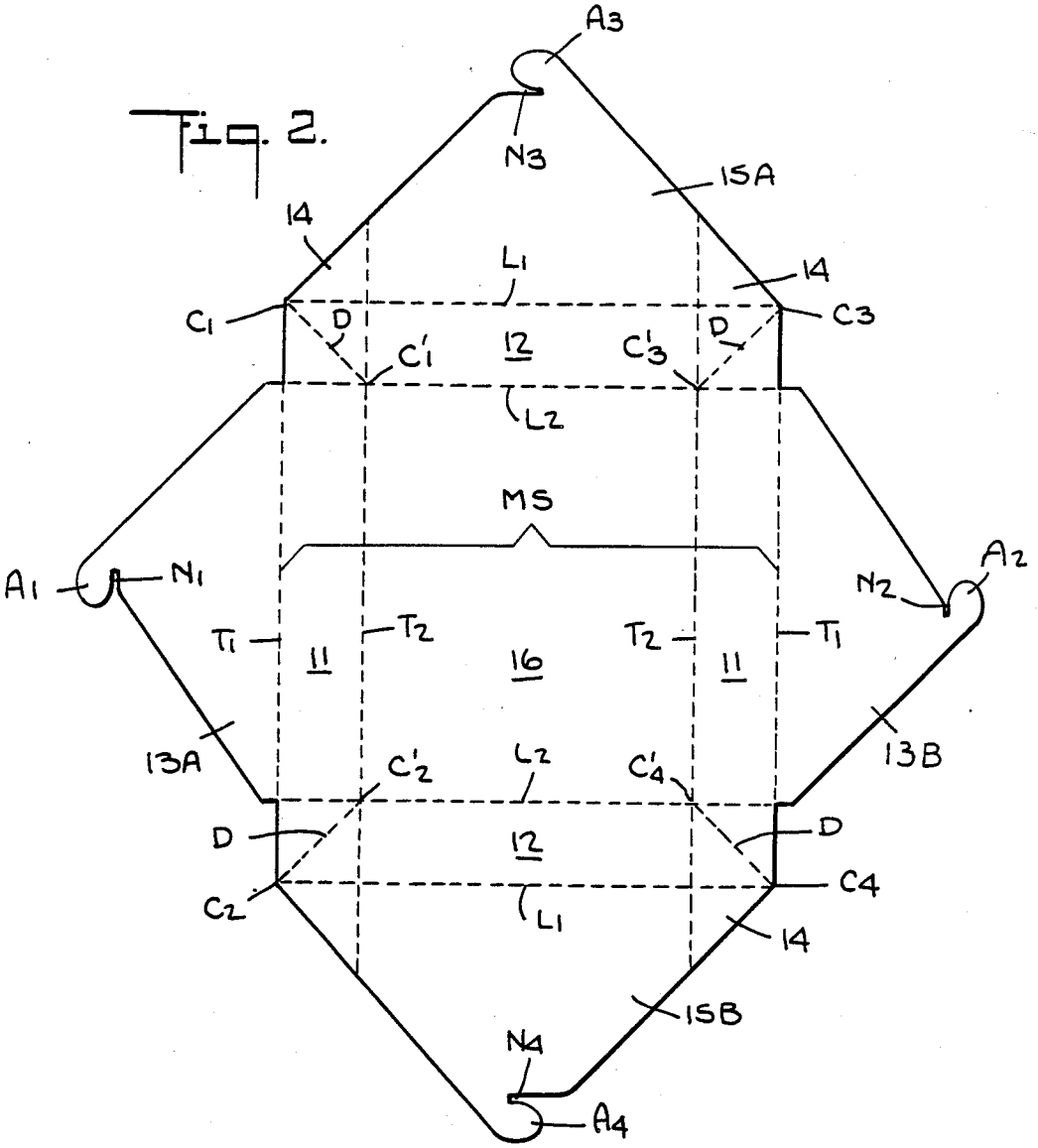
FIG. 2 is a plan view of the die-cut and scored blank from which the box is formed.

The blank, as shown in FIG. 2, is die-cut and scored to define a rectangular main section MS whose corners are $C_1$, $C_2$, $C_3$ and $C_4$. Extending from the ends of the rectangular main section MS are triangular end flaps 13A and 13B having rounded apexes $A_1$ and $A_2$ which are notched at $N_1$ and $N_2$ to form complementary interlockable tabs.

A first transverse fold line $T_1$ is scored at the junction of each end flap (13A and 13B) and main section MS, line $T_1$ extending between the corners of main section MS. A second transverse fold line $T_2$ parallel to line $T_1$ is scored in main section MS. Extending from either side of main section MS between the second transverse fold lines $T_2$ are a pair of triangular side flaps 15A and 15B, a first longitudinal fold line $L_1$ being scored at the junction of these flaps and main section MS. Triangular side flaps 15A and 15B have rounded apexes $A_3$ and $A_4$ which are notched at $N_3$ and $N_4$ to form complementary interlockable tabs.

Also scored in main section MS is a second longitudinal fold line $L_2$ in parallel to longitudinal line $L_1$. Longitudinal fold line $L_2$ extends into end flaps 13A and 13B to intersect transverse line $T_2$ and join transverse line $T_1$.

The intersecting longitudinal and transverse fold lines $L_1$ and $L_2$ and $T_1$ and $T_2$ define (a) the bottom wall 16 of the box which is bounded by lines $T_2$ and $L_2$, (b) end walls 11 which are bounded by lines $T_1$ and $T_2$, and (c) side walls 12 which are bounded by lines $L_1$ and $L_2$. Also defined by the intersecting fold lines are trapezoidal corner zones 14 which interconnect the side walls and end walls.

A diagonal fold line D extends between the apex of each trapezoid (corners $C_1$ to $C_4$ of main section MS) and the intersection of transverse line $T_2$ and longitudinal line $L_2$. These points of intersection are at the corners $C'_1$to $C'_4$ of bottom wall 16.

Figure 3:
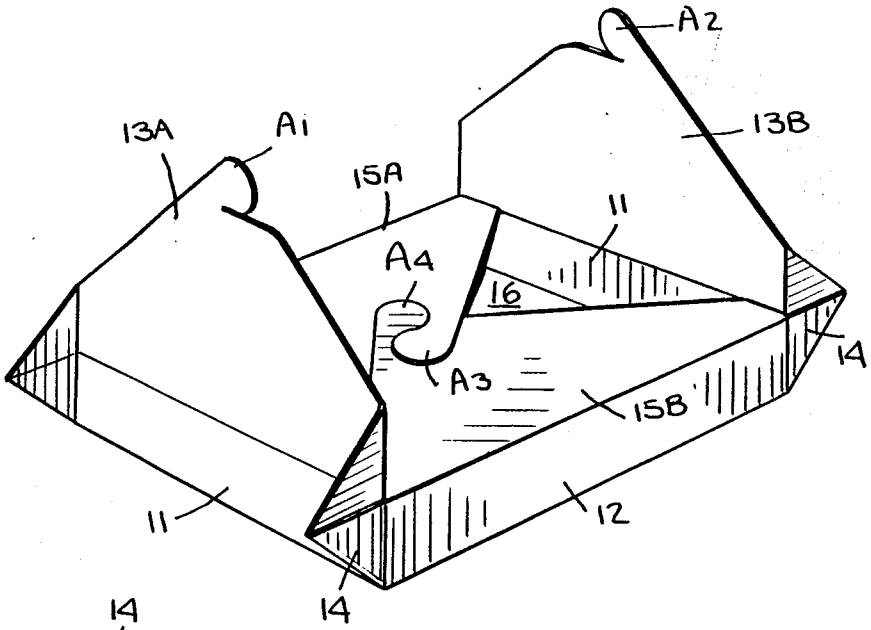
FIG. 3 is a perspective view of the box when partially erected, with the side flaps closed and the end flaps raised.
Figure 4:
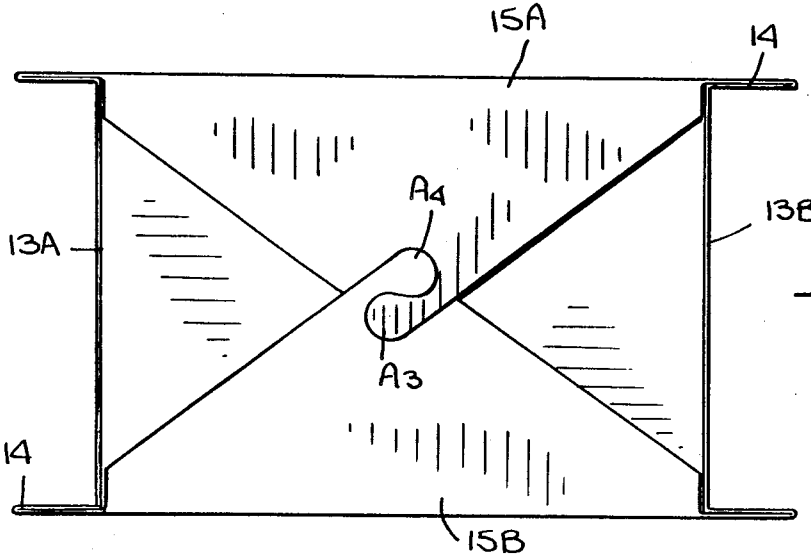
FIG. 4 is a top view of the partially erect box.

To erect the box, first side walls 12 are folded up on longitudinal line $L_2$ at right angles to the bottom wall 16, as shown in FIGS. 3 and 4, and triangular side flaps 15A and 15B are then folded in and interlocked. In practice, before doing so, the article to be boxed is first placed on the bottom wall 16 of the blank so that the box can then be erected about the article.

Figure 5:
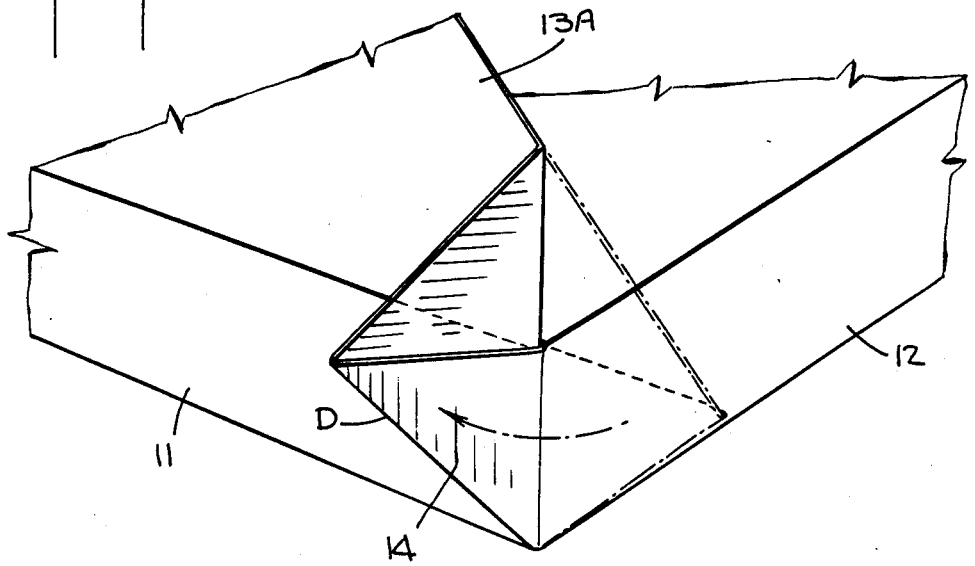
FIG. 5 shows one corner of the partially erect box.

Then end walls 11 are folded up at right angles to bottom wall 16 on transverse lines $T_2$. This action causes the trapezoidal zone 14 to fold on diagonal fold line D to create gussets which when end flaps 13A and 13B are raised, are outstretched, as shown in FIGS. 4 and 5. But when end flaps 13A and 13B are folded down to overlie the interlocked side flaps 15A and 15B, then gussets 14 swing in to lie against the corners of the box and bolster these corners, as shown in FIG. 1, and thereby strengthen the box. Flaps 13A and 13B are then interlocked at their apexes to complete the box.

To remove the article from the box, one simply unlocks and raises flaps 13A and 13B and then unlocks and raises flaps 15A and 15B, at which point the box may be flattened to resume its original blank form.

This has distinct advantages when the article boxed is a pie or other relatively delicate object, for it is not necessary as in a conventional box to remove the article from the box and in doing so, possibly injuring the article; for one has only to unwrap, as it were, the box from the article.

While there has been shown and described a unitary gift box in accordance with the invention, it will be appreciated that many changes and modifications may be made therein without, however, departing from the essential spirit thereof.

I claim:

1. A single flat blank formable into a unitary box, said blank being die-cut and scored to define bottom, side and end walls as well as a pair of generally triangular side flaps hinged to the side walls and a pair of generally triangular end flaps hinged to the end walls, each pair of said flaps having interlocking apexes, said blank including a main rectangular section from whose ends the triangular end flaps extend and from whose sides the triangular side flaps extend, a first transverse fold line being scored between each end flap and the main section and a second transverse fold line being scored in the main section in parallel to the first transverse line, the first and second transverse lines bordering the end walls, a first longitudinal fold line being scored between each side flap and the main section and a second longitudinal fold line being scored in the main section in parallel to the first longitudinal fold line, the first and second longitudinal lines bordering the side walls, said second longitudinal fold line extending into the end flaps to intersect the first and second transverse lines to define trapezoidal zones interconnecting the end and side walls, each zone having a diagonal fold line scored therein extending between an end of the first transverse line and the intersection of the second transverse line and the second longitudinal line, whereby when the blank is erected and the trapezoidal zones are each folded out on the diagonal fold line, the resultant box is provided with gussets which reinforce its corners.

2. A blank as set forth in claim 1, formed of cardboard.

3. A blank as set forth in claim 1, wherein said interlocking apexes are constituted by complementary notched tabs.

4. A blank as set forth in claim 1, formed of synthetic plastic sheeting material.

* * * * *